United States Patent [19]

Carey et al.

[11] Patent Number: 4,724,650

[45] Date of Patent: Feb. 16, 1988

[54] SUBCEILING BEAM INTERSECTION

[75] Inventors: Bruce P. Carey, Saugus; Richard M. O'Toole, Culver City, both of Calif.

[73] Assignee: USG Corporation, Chicago, Ill.

[21] Appl. No.: 913,335

[22] Filed: Sep. 30, 1986

[51] Int. Cl.[4] ..... E04B 5/14

[52] U.S. Cl. ..... 52/665; 52/648

[58] Field of Search ..... 52/664, 665, 488, 648, 52/484, 741, 745; 403/173; 29/DIG. 3, 513

[56] References Cited

U.S. PATENT DOCUMENTS

| | | | |
|---|---|---|---|
| 2,694,614 | 11/1954 | Dent | 403/173 |
| 3,089,570 | 5/1963 | O'Neil, Jr. | 189/88 |
| 3,590,544 | 7/1971 | Shepherd | 52/484 |
| 3,628,299 | 6/1970 | Nakazawa et al. | 52/488 |
| 3,785,110 | 1/1974 | Galloway et al. | 52/715 |
| 3,835,614 | 9/1974 | Downing, Jr. | 52/666 |
| 3,848,385 | 11/1974 | Thompson | 52/475 |
| 4,019,300 | 4/1977 | Saver et al. | 52/665 |
| 4,125,973 | 11/1978 | Lendrihas | 52/648 |
| 4,276,731 | 7/1981 | Henggeler et al. | 52/665 |
| 4,438,613 | 3/1984 | Hintsa et al. | 52/484 |
| 4,485,605 | 12/1984 | LaLonde | 52/665 |
| 4,516,376 | 5/1985 | King | 52/648 |
| 4,540,847 | 9/1985 | Gardner | 52/484 |
| 4,545,165 | 10/1985 | Carey et al. | 52/488 |

FOREIGN PATENT DOCUMENTS

| | | | |
|---|---|---|---|
| 2408923 | 9/1975 | Fed. Rep. of Germany | 52/484 |
| 2456522 | 8/1976 | Fed. Rep. of Germany | 52/488 |

*Primary Examiner*—James L. Ridgill, Jr.

*Attorney, Agent, or Firm*—A. Lewis Worthem, Jr; Robert H. Robinson; Robert M. Didrick

[57] ABSTRACT

An intersection spacer is disclosed for use in a subceiling structure of a grid of open-ended runner beams and intersecting open-ended cross beams, the intersection spacer being generally square in horizontal cross section with inverted vertical corner edges forming four outwardly directed protrusions adapted to engage within the beam ends. A top plate on the spacer bears the weight of the ceiling. A bottom cap on the spacer carries a decorative panel. The spacer may be made of two identical mating halves. A method of assembling a subceiling with such intersection spacers is also disclosed.

15 Claims, 3 Drawing Figures

SUBCEILING BEAM INTERSECTIONBACKGROUND OF THE INVENTION

1. Field of the Invention

This invention relates to the field of architectural subceilings for commercial, industrial, and residential buildings. More particularly, it relates to suspended open subceiling configurations having a grid pattern of intersecting open-ended runner beam sections and open-ended cross beam sections formed of sheet material.

In addition to the usual subceiling requirements of producibility, cost effectiveness, appearance and safety, the particular field addressed by this invention requires that the component parts of the subceiling be prefabricated ready for easy assembly and installation at the final site without requiring high skill levels or special tools. The completed subceiling must present a finished appearance, free of light leaks at joints and intersections, and all fastening hardware such as rivets or screws must be completely concealed from a viewer anywhere in the room below.

2. The Prior Art

Intersection structures heretofore known for joining runner beams and cross beams in a suspended subceiling have largely addressed the field of support rails for panels, where at least a major portion of the structure, being concealed by the panels, could be designed functionally with little concern for aesthetic appearance. Consequently, even those approaches which could be adapted structurally to an open grid beam subceiling configuration pose formidable problems in attempting to meet the standards of aesthetic appearance demanded in the particular field addressed by this invention.

An additional requirement is that, because subceilings of this type often stand free in a room without abutting the walls, the perimeter and corner intersections must present a finished appearance. Existing intersection joining systems would leave an unacceptable unfinished appearance due to gaps and unconcealed fastening structure or else would require additional trim parts to be installed around the perimeter.

A further requirement is that the intersection structure must be light in weight to minimize the total loading stress on the supporting structure. Consequently, metal castings or other such heavy configurations used in the structural fields are unsatisfactory.

Known subceiling systems which require complete prefabrication of the entire subceiling offsite are impractical for all but very small rooms. Prefabricating and shipping full length runner beams is also unsatisfactory. However, known subceiling systems in which both the runner beams and the cross beams may be installed in short sections fail to satisfy one or more of the above requirements.

An increasing demand for suspended subceilings in the architectural style of an open grid framework of intersecting beams has created a heretofore unfulfilled need for an intersection structure which fully satisfies the abovementioned requirements.

SUMMARY OF THE INVENTION

The present invention overcomes the shortcomings of existing beam intersection methods and structures, and fully satisfies all of the requirements cited by providing a lightweight intersection spacer assembly onto which open ends of runner beam sections and cross beam sections may be assembled to form a suspended subceiling.

Outwardly facing protrusions on all four sides of the spacer fit into the open ends of the beam sections, which are secured to a top plate on the spacer by fasteners inserted on the top side of the beams where by fasteners are concealed from normal view. The top plate is attached to a rod or wire grid suspension element for suspending the subceiling from structure above.

When the spacers are used at the corners and perimeter of the subceiling, they present a finished appearance requiring no further trim treatment even in installations where the perimeter of the subceiling stops short of the walls.

The lower edge of the open ends of the runner beam sections may be provided with tabs to be inserted thru slots near the bottom of the spacer and bent upward to stiffen the beams temporarily during installation while they are being suspended in place.

A cap snaps onto a skirt at the bottom of each spacer to conceal the bent-over tab ends. The cap presents a finished appearance without further treatment. However, as a styling option, a removeable decorative panel may be placed in a recessed area provided at the bottom of each cap.

According to a feature of the invention, the intersection spacer comprises two identical core body halves joined together along vertical seams. The core body parts may be made of molded plastic, while the top plate is advantageously made of metal.

In the completed subceiling, the weight of the beams is carried by the suspended top plates with virtually no stress applied to the core body.

Other features and advantages of the invention will become apparent from the description of the preferred embodiment which follows.

DESCRIPTION OF THE PREFERRED EMBODIMENT

Figure 1:
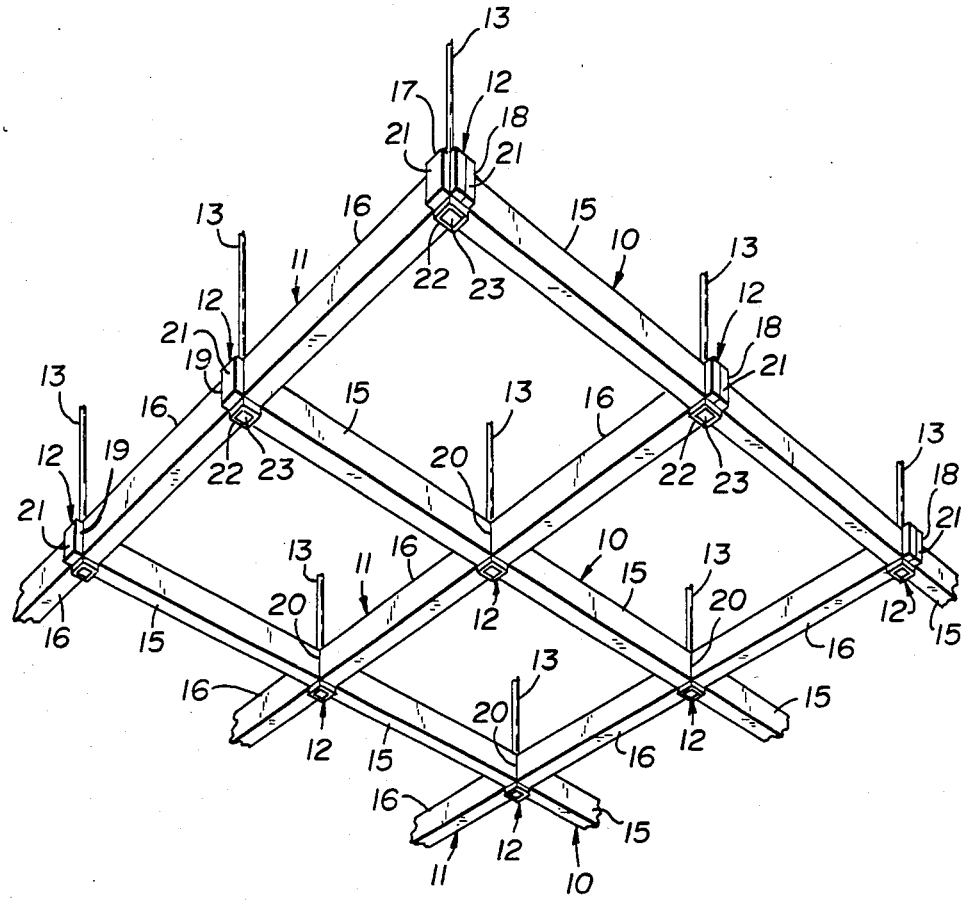
FIG. 1 is a fragmentary underside oblique perspective view of a completed subceiling constructed with intersection spacers according to the invention.

By way of disclosing a preferred embodiment of the invention, and not by way of limitation, FIG. 1 shows a completed and installed subceiling. The subceiling includes in its general organization a number of spaced, parallel runner beams 10, spaced, parallel cross beams 11, intersection spacers 12 disposed at the intersections between beams, and suspension elements 13 which may be wires or rods and which are secured at their lower ends to the intersection spacers 12 and at their upper ends to suitable structure above.

Each runner beam 10 is made up of a colinear run of similar runner beam sections 15. In like manner, each cross beam is made up of a colinear run of cross beam sections 16. These beams sections are each hollow and formed of folded sheet metal. The intersection spacers 12 are variously located at intersections of one runner beam section 15 with one cross beam section as at 17, two runner beam sections with one cross beam section as at 18, one runner beam section with two cross beam sections as at 19, and two runner beam sections with two cross beam sections as at 20. About the outer perimeter of the subceiling, the intersection spacers exhibit outwardly facing protrusions 21 having the appearance of short extensions of the beams. Bottom caps 22 with decorative panels 23 are visible at the undersides of the intersection spacers 12.

Figure 2:
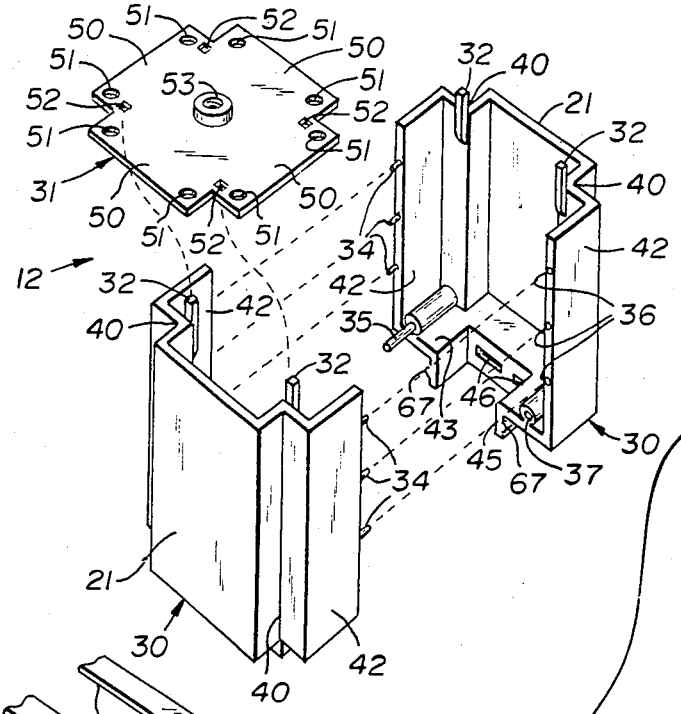
FIG. 2 is an oblique isometric exploded view of an intersection spacer according to the invention.

FIG. 2 shows the arrangement and assembly of the intersection spacers 12. Identical half-shells 30, when assembled together, form a core body, which in turn, when assembled together with a top plate 31 will become an intersection spacer 12.

Each half-shell has a pair of boss-supported upwardly extending pins 32 at the top end, a row of small seam-alignment pins 34 and a larger boss-supported bottom-alignment pin 35 on one mating edge, a corresponding row of seam-alignment holes 36 and a boss-enclosed bottom-alignment hole 37 on the other mating edge.

The half-shells 30 are each shaped to have inverted vertical corner edges 40 forming a rectangular protrusion 21 and two rectangular half protrusions 42. These are provided with a protrusion floor 43. At the bottom of the the protrusion floor depending at the bottom of the half-shell is a skirt 45. Formed through the skirt are slotted openings 46.

Top plate 31 has a perimeter outline corresponding to the generally square cross section of the core body as assembled from the half-shells 30, including four rectangular side extensions 50, each of which has a pair of holes 51. Near the four inverted corners are four holes 52 corresponding to the lcoations of pins 32. At the center is a grommet 53 having a threaded bore for attachment to a suspension element 13.

After the two half-shells 30 are assembled together by inserting pins 34 and 35 of one into holes 36 and 37 of the other with a solvent type adhesive applied for bonding the halves together to form a core body, top plate 31 is positioned on top of the core body by inserting pins 32 through holes 52. the completed intersection spacer thus formed presents four outwardly extending rectangular protrusions, each shaped and sized to fit, along with a corresponding top plate extension, into an open end of a hollow beam section.

Figure 3:
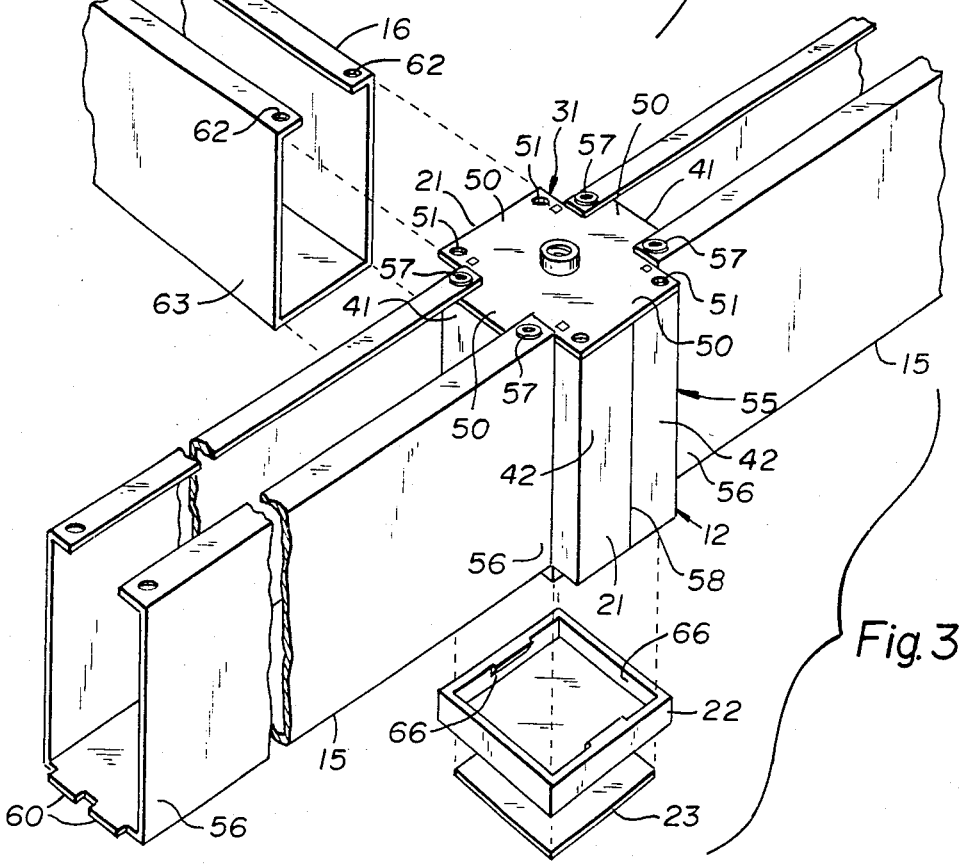
FIG. 3 is a fragmentary oblique isometric view showing two sections of a runner beam joined together by an intersection spacer according to the invention, and including an exploded view of a cross beam section and a bottom cap according to the invention.

FIG. 3 shows an assembled intersection spacer 12 comprising a core body 55 and a top plate 31 attached to open ends of runner beam sections 15 which are typically two inches by four inches formed from sheet metal with a gap along the top side. Each runner beam section end 56 fits over a protrusion 21 and top plate extension 50, and is attached to the top plate by a pair of blind rivets 57 or sheet metal screws inserted through a pair of holes provided on the top side of the beam end and a pair of holes 51 in each top plate side extension.

The runner beam section ends 56 are fabricated with a pair of tab extensions 60 at their bottom sides. These tabs, after assembly, protrude through the slotted openings 46 shown in FIG. 2. The protruding protions of the tabs may be bent upward to provide bottom fastening for additional runner beam stiffness during assembly and initial suspension of the runner beams during installation.

It may be seen in FIG. 3 that the cross beam sections fit over the protrusions 21 formed by the adjoining half protrusions 42. Also, it may be see that the core body 55 exhibits seams disposed in a vertical plane bisecting the core body through the centers of two opposite sides.

In installation, typically the runner beams are assembled from runner beam sections joined by intersection spacers prior to attachment of cross beam sections, as shown in FIG. 3. The intersection spacers are suspended in place by suspension elements attached to the threaded grommets in the top plates. Levelling of the beams may be accomplished such as by threaded suspension element adjustments of known art.

It should be noted that the ends of cross beam sections 16 are cut off in a single plane since it does not require tabs as at 60 on the runner beam section ends. Fastening of the cross beam sections is accomplished with a pair of blind rivets or sheet metal screws inserted through holes 62 in the runner beam end 63 and through a pair of holes 51 in top plate 31 in the same manner as with the runner beam sections 15.

Assembling one cross beam section end 63 to the intersection spacer along with two runner beam sections ends 56 forms a three-way intersection for use at the perimeter of a subceiling. The unattached protrusion 21 remains exposed as a finish trim feature at the subceiling perimeter, with the seam 58 being rendered unnoticable by virtue of accurate mating of the two half-shell parts accomplished by the seam alignment pins 34 of one half-shell engaging holes 36 of the other half-shell, in conjunction with the aforementioned adhesive bonding at the mating surfaces.

Shown at the bottom of FIG. 3 is bottom cap 22 which is square with an upwardly extending perimeter lip 66 on the inside of which are two oppositely disposed detents 66. Corresponding protrusions 67 are provided on the outside of the core body bottom skirt 45 as shown in FIG. 2. To finish the bottom of the intersection spacer, bottom cap 22 is pushed upwards and snapped over the core body bottom skirt where it is held in place by detent action of recesses 66 engaging corresponding detent protrusions 67.

The bottom side of bottom cap 22 is provided with a square recess for retaining an optional decorative panel 23 which may be finished in a color or texture chosen for special decorative effect. The panel may be held in place by a suitable adhesive, and may be replaced for redecorating purposes.

This invention is susceptible of variations in dimensions, proportions, shapes, and materials, and may be implemented in various alternative embodiments by those skilled in the art without departing from the scope of the claims which follow.

What is claimed is:

1. In a subceiling structure having a horizontally disposed open grid of open-ended, parallel, runner beam sections arranged substantially perpendicularly to open-ended, parallel cross beam sections, an intersection spacer disposed at grid intersections formed between adjacent ends of said runner beam sections and said cross beam sections, said intersection spacer comprising:

a core body having a top end, a bottom end, and four similar vertical sides forming a generally rectangular horizontal cross-section with four vertically extending corner edges inverted inwardly so as to present at each vertical side an outwardly-facing protrusion shaped and sized to fit into an open end of a beam section and having the appearance of a finished beam end extension, at least one of a first oppositely-disposed pair of said protrusions engaged within the open end of a runner beam section and at least one of a second oppositely-disposed pair of said protrusions engaged within the open end of a cross beam section.

2. The intersecton spacer of claim 1 wherein said core body comprises an identical pair of half-shells engaged together along seams disposed in a vertical plane bisecting the core body through the centers of two opposite sides.

3. The intersection spacer of claim 2 further comprising a plurality of coaligned pins and openings spaced along said seams.

4. The intersection spacer of claim 1 further comprising a horizontally disposed top plate upon the top end of said core body, said top plate having a peripheral outline shaped similarly to the horizontal cross-section of said core body thus forming four top plate side extensions engageable within open ends of said runner beam sections and said cross beam sections.

5. The intersection spacer of claim 4 further comprising means on said top plate for securing to said runner beam sections or said cross beam sections.

6. The intersection spacer of claim 5 wherein said means for securing comprises a plurality of openings formed through said top plate adapted for alignment with corresponding openings formed through said runner beam sections and said cross beam sections and for receiving a fastener inserted therethrough.

7. The intersection spacer of claim 4 further comprising coacting engagement means on said core body and on said top plate for holding said top plate in position upon said core body.

8. The intersection spacer of claim 7 wherein said engagement means comprises a plurality of upwardly extending pins on said core body and a plurality of openings formed through said top plate for receiving said pins.

9. The intersection spacer of claim 4 further comprising means on said top plate for engaging a grid suspension element.

10. The intersection spacer of claim 9 further comprising a decorative panel secured to the underside of said cap.

11. The intersection spacer of claim 9 wherein said core body is hollow and formed of molded plastic and wherein said top plate is metal.

12. The intersection spacer of claim 1 further comprising a depending skirt formed at said core body bottom end.

13. The intersection spacer of claim 12 further comprising a plurality of openings formed through said skirt, said openings adapted to receive tab extensions formed at the lower extents of the ends of said runner beams.

14. The intersection spacer of claim 12 further comprising a bottom cap having an upwardly extending peripheral lip adapted to engage and cover said skirt, said lip overlying said skirt.

15. The intersection spacer of claim 14 further comprising coacting detents and protrusions formed on overlying surfaces of said lip and said skirt for retaining said cap on said skirt.

* * * * *